US006030235A

United States Patent [19]

Ittah et al.

[11] Patent Number: 6,030,235

[45] Date of Patent: Feb. 29, 2000

[54] CONNECTOR HAVING A LOCKING LEVER

[75] Inventors: Jean Ittah, Villeneuve La Garenne; Thierry Badaroux, St-Germain En Laye, both of France

[73] Assignee: Connecteurs Cinch, Montigny Le Bretonneux, France

[21] Appl. No.: 08/969,591

[22] Filed: Nov. 12, 1997

[30] Foreign Application Priority Data

Dec. 3, 1996 [FR] France ..... 96 14806

[51] Int. Cl.[7] ..... H01R 13/62

[52] U.S. Cl. ..... 439/157

[58] Field of Search ..... 439/152–160, 439/372

[56] References Cited

U.S. PATENT DOCUMENTS

| | | | |
|---|---|---|---|
| 5,269,696 | 12/1993 | Okada et al. | 439/157 |
| 5,484,297 | 1/1996 | Takahashi et al. | 439/157 |
| 5,562,465 | 10/1996 | Taguchi et al. | 439/157 |
| 5,609,494 | 3/1997 | Yamaguchi et al. | 439/157 |
| 5,676,556 | 10/1997 | Yamaguchi et al. | 439/157 |
| 5,823,809 | 10/1998 | Wakata | 439/157 |

FOREIGN PATENT DOCUMENTS

| | | |
|---|---|---|
| 532366 | 3/1993 | European Pat. Off. . |
| 6243930 | 9/1994 | Japan . |
| 8213102 | 8/1996 | Japan . |

OTHER PUBLICATIONS

Patent Abstract of Japan, vol. 096, No. 012, Dec. 26, 1996.
Patent Abstract of Japan, vol. 018, No. 626 (E–1636), Nov. 29, 1994.

*Primary Examiner*—Gary F. Paumen
*Assistant Examiner*—Tho D. Ta
*Attorney, Agent, or Firm*—Greenblum & Bernstein, P.L.C.

[57] ABSTRACT

Connector includes a housing member to which is articulated a locking lever having a holding bar held in a locked position by a latch. An abutment is provided against which the corresponding edge of the lever bears in the locked position. This edge is in the form of an elastic tongue.

8 Claims, 3 Drawing Sheets

FIG.4
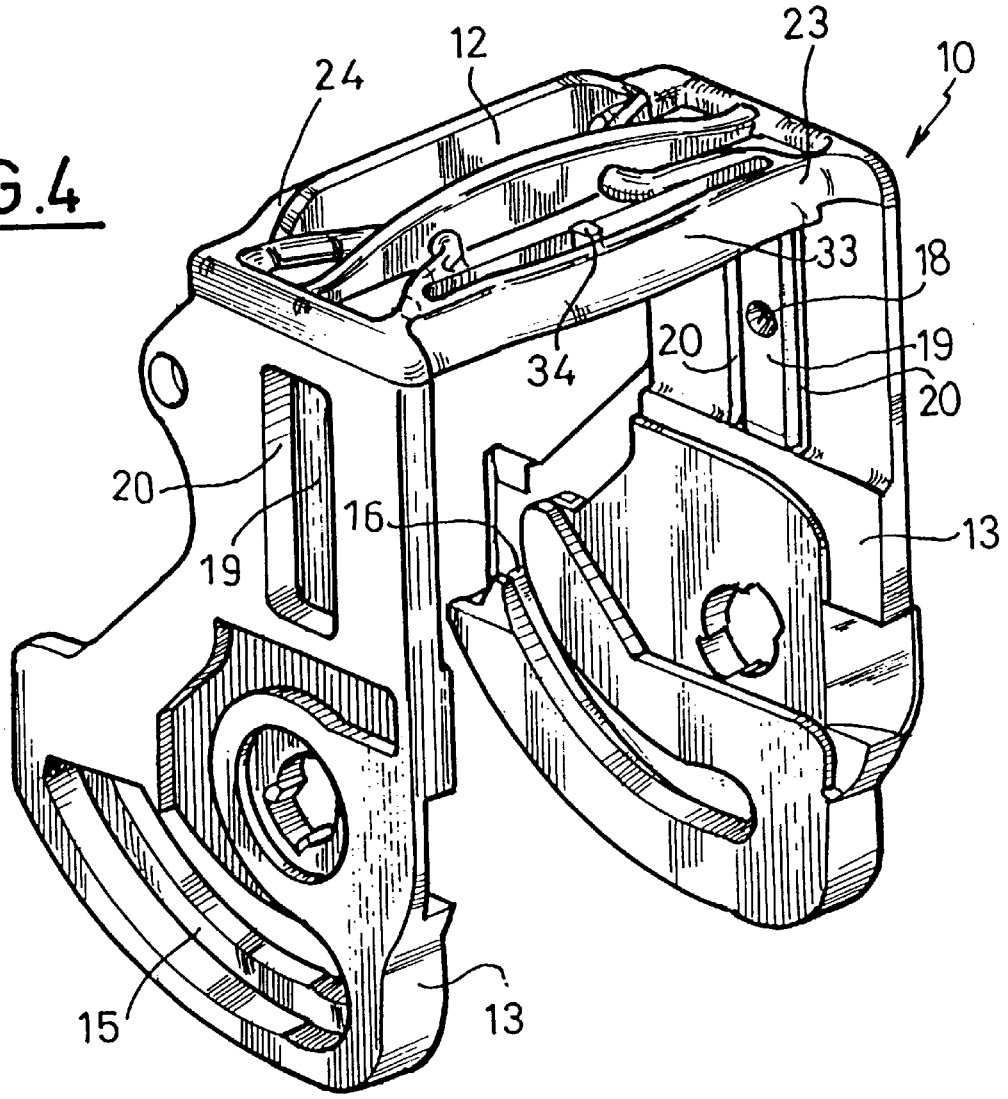
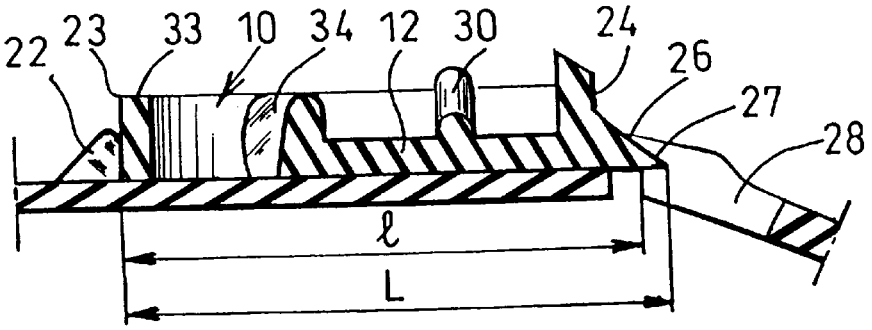
FIG.3

CONNECTOR HAVING A LOCKING LEVER

BACKGROUND OF THE INVENTION

1. Field of the Invention

The present invention concerns a connector having a locking lever.

2. Description of the Prior Art

The invention concerns connectors comprising a female housing member, a male housing member, one of the two members having the flanges of a locking lever articulated to two opposite walls and the other member having pins on the corresponding wall adapted to cooperate with cams of the flanges.

Connectors of the above kind have the advantage of allowing effortless insertion of large numbers of male electrical contact tongues of one of the housing members into female electrical contact members of the other.

A latch is generally provided to lock the lever in the closed position. It has been found that under some conditions of use, in particular if the connector is subject to vibration, the lever can unintentionally pivot towards the rest position, allowing the housing members to become uncoupled.

It has been found that to avoid this drawback it is necessary for the lever when in the locked position to be perfectly immobilized between an abutment and the latch, which requires an extremely accurate mold for molding the housing member and the lever adapted to be mounted on the latter.

One aim of the present invention is to immobilize the lever in the locked position in a very reliable and effective manner, without increasing the unit cost.

SUMMARY OF THE INVENTION

The invention consists in a connector having a locking lever and comprising a female housing member and a male housing member one of which has pins on two opposite walls and the other of which has a U-shape locking lever with two flanges and a holding bar pivoted to two corresponding walls, each flange including a cam adapted to cooperate with a corresponding pin, the lever being adapted to occupy a rest position in which the cams are separated from the pins to allow engagement of the male member in the female member and a locked position, after pivoting, in which the pins cooperate with the cams, the housing member to which the lever is pivoted having an abutment against which an edge of the holding bar bears and a latch for immobilizing the lever in the locked position, wherein the edge of the holding bar cooperating in the locked position of the lever with the abutment is elastic.

By virtue of this arrangement, when in the locked position the lever is perfectly immobilized and there is no risk of it unlocking unintentionally.

According to one constructional feature, the latch includes an elastic lug on the corresponding housing member with a lip adapted to cooperate with a projection on an edge of said holding member of said lever opposite said elastic edge, formed by an opening in said holding member forming a curved elastic tongue a convex side of which faces towards said abutment.

For said lever to remain locked, even if the lever is forcibly unlocked without retracting the elastic lug, the lip has a nose whose face that faces towards the elastic lug is at an acute angle to the latter, the projection on the edge of the holding member having a corresponding shape.

To prevent damage to the elastic tongue, the edge of the opening in the holding member opposite the elastic tongue includes an abutment part-way along its length.

Finally, in accordance with a final feature of the invention the distance between the abutment against which the elastic tongue of the nose of the pin bears and the elastic lug is slightly less than that between the free end of the projection and the convex edge of the elastic tongue. Accordingly, when locking the lever, it is necessary to apply a slight pressure to it in order to be sure that locking is effective.

The invention will now be described in more detail with reference to a specific embodiment given by way of example only and shown in the accompanying drawings.

BRIEF DESCRIPTION OF THE DRAWINGS

FIG. 3 is a cross-sectional view to a larger scale taken along the line 3—3 in FIG. 2.

FIG. 4 is a perspective view of the locking lever.

DETAILED DESCRIPTION OF THE PREFERRED EMBODIMENT

Figure 1:
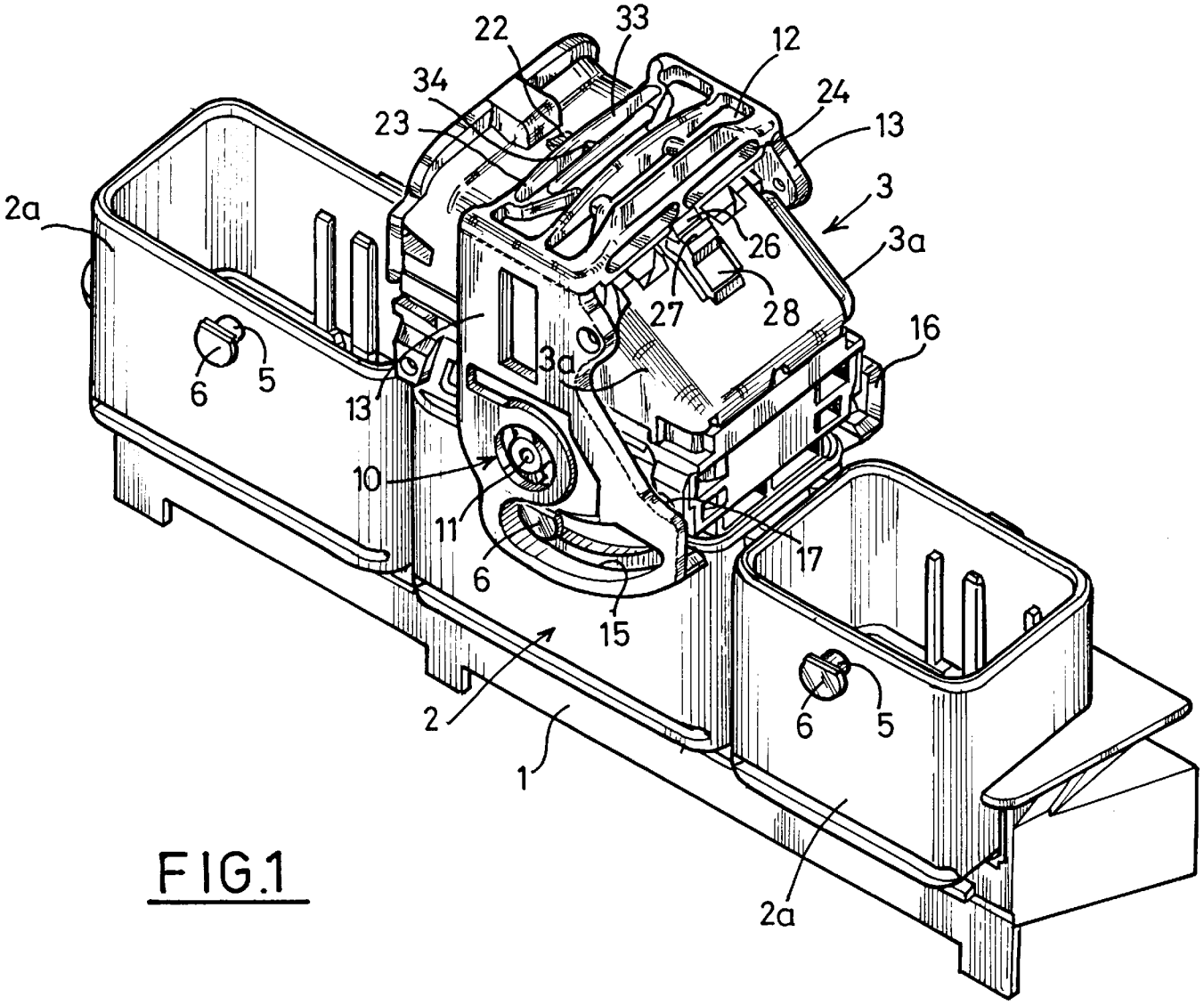
FIG. 1 is a perspective view of a connector in accordance with the invention.
Figure 2:
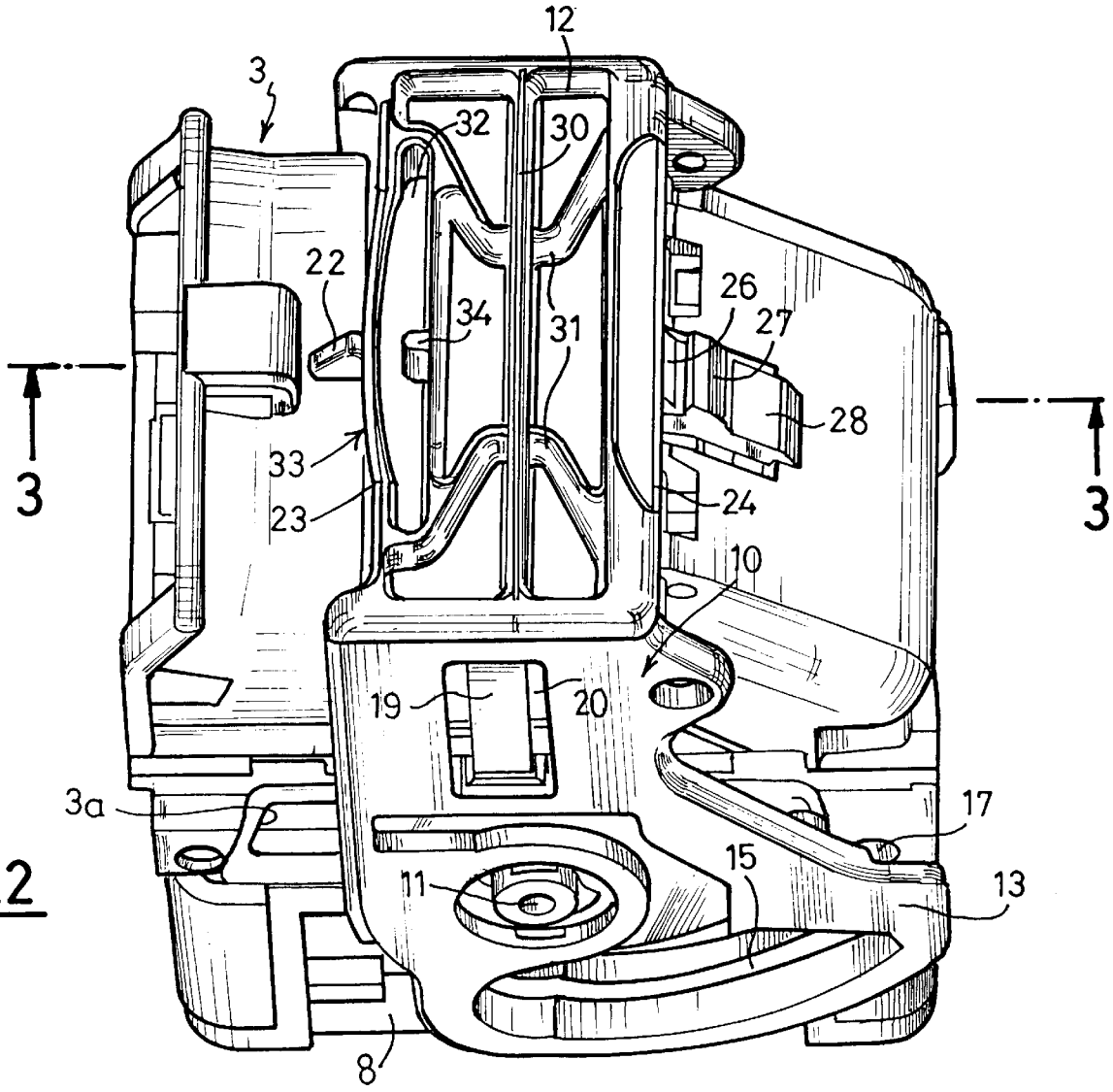
FIG. 2 is a perspective view of the male member of the connector from FIG. 1.

The connector shown in the figures comprises a base 1 with female members 2 adapted to receive male members 3.

Each female member 2 has, on the bottom, pins (not shown) adapted to cooperate with female electrical contact members accommodated in passages of the male member 3.

Each female member 2 has a pin 5 with a head 6 on two opposite walls 2*a*.

The male member 3 has one end 8 adapted to be inserted into the corresponding female member with journals 11 on two opposite walls 3*a* on which a locking lever 10 pivots.

The figures show the lever 10 pivoted on the male member, but it could be mounted on a female member, of course, the male member carrying the pins 5.

The locking lever 10 is U-shape with a holding bar 12 and two flanges 13, each flange 13 having near its free end a cam 15 with an opening 16 at one end.

Near the bar 12 each flange 13 has a boss 18 on its inside face carried by a thin bar 19, slots 20 being formed on respective opposite sides of each bar to increase its elasticity.

Cavities 17 adapted to receive the bosses 18 in the rest position of the locking lever 10 are provided on the male member 3.

On the male member 3 is an upstanding abutment 22 against which an edge 23 of the holding bar 12 bears in the locked position and a latch for immobilizing the lever in this position and having, on the edge 24 of the holding bar 12, a projection 26 adapted to cooperate with a lip 27 of an elastic locking lug 28.

The elastic locking lug 28 is formed by a cut-out in the lateral wall of the body of the male member and the lip 27 has a nose at an acute angle to the lug 28, the projection 26 having a corresponding shape so that, if any attempt is made to tilt the lever 10 in the unlocking direction without retracting the lug 28, these members cooperate with each other to oppose unlocking of the lever.

As can be seen in the figures, the holding bar 12 has a central stiffener rib 30 and two V-shape ribs 31 on its outside face. An opening 32 is formed in the part of the holding bar 12 near the edge 23 to form an elastic tongue 33 which is convex with the convex side facing towards the edge 23.

An abutment 34 is formed in the opening 32, facing the tongue 33.

The distance l between the nose of the lip 27 and the abutment 22 is slightly less than the distance L between the free end of the projection 26 and a mid-point on the outside surface of the elastic tongue 33.

To insert the member 3 into the female member 2 the lever 10 is placed in the rest position after which part of the body of the member 3 is inserted in the female member 2 and the lever 10 is pivoted into the locked position. During this movement, the pins 5 engage in the openings 16 of the cams 15 which, given their profile, command the insertion of the male tongues of the female members 2 into the female members in the passages in the male members 3.

When the lever reaches the locked position, the projection 26 causes the lug 28 to be retracted elastically and the elastic tongue 33 bears against the abutment 22, after which the lug 28 returns to its initial position as soon as the projection 26 has passed the lip 27, with the result that the lever is locked.

The lever is immobilized in this position and there is no risk of it unlocking unintentionally. Moreover, because the elastic tongue 33 takes up any play, under conditions in which the connector is subjected to strong vibrations, there is no risk of the lever pivoting and the male member 3 uncoupling.

The abutment 34 limits bending of the elastic tongue 33 and so prevents it being forced and possibly broken.

Of course, the invention is not limited to the embodiment just described and shown. Many modifications of detail can be made to the latter without departing from the scope of the invention.

There is claimed:

1. A connector comprising:

a female housing member;

a male housing member;

pins on opposite walls of one of said female housing member and said male housing member, and the other of said female housing member and said male housing member including a U-shape locking lever;

said locking lever including two flanges and a holding bar, said holding bar including an elastic tongue, said lever being pivoted to two corresponding a walls of the other of said female housing member and said male housing member, each of said two flanges including a cam adapted to cooperate with a corresponding one of said pins, said lever being adapted to occupy a rest position wherein said cams are separated from said pins to allow engagement of said male housing member in said female housing member, and a locked position, after pivoting, wherein said pins cooperate with said cams; and said male housing member including an abutment against which an edge of said elastic tongue holding bar bears and a lock capable of immobilizing said lever in said locked position, said lock comprising an elastic lug including a lip, said lever including a projection constructed and arranged so that during pivoting of the lever into the locked position said projection causes the elastic lug to bend and cooperate with said lip, and said elastic tongue elastically bears against said abutment.

2. The connector according to claim 1, wherein said pins are mounted on said female housing member, and said lever is pivoted on said male housing member.

3. The connector according to claim 1, wherein said lip includes a nose comprising a face that faces towards said elastic lug at an acute angle thereto, and said projection is mounted on said edge of said elastic tongue and comprises a corresponding shape.

4. The connector according to claim 3, wherein said pins are mounted on said female housing member, and said lever is pivoted on said male housing member.

5. The connector according to claim 1, wherein an edge of said holding bar opposite said elastic tongue comprises an abutment part-way along a length thereof.

6. The connector according to claim 5, wherein said pins are mounted on said female housing member, and said lever is pivoted on said male housing member.

7. The connector according to claim 1, wherein each of said pins includes a head.

8. The connector according to claim 7, wherein said pins are mounted on said female housing member, and said lever is pivoted on said male housing member.

* * * * *